US010265956B2

(12) United States Patent
Nakakubo

(10) Patent No.: US 10,265,956 B2
(45) Date of Patent: Apr. 23, 2019

(54) LIQUID EJECTION HEAD AND METHOD OF MANUFACTURING LIQUID EJECTION HEAD

(71) Applicant: CANON KABUSHIKI KAISHA, Tokyo (JP)

(72) Inventor: Toru Nakakubo, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/813,351

(22) Filed: Nov. 15, 2017

(65) Prior Publication Data

US 2018/0154634 A1 Jun. 7, 2018

(30) Foreign Application Priority Data

Dec. 6, 2016 (JP) ..... 2016-236635

(51) Int. Cl.
*B41J 2/14* (2006.01)
*B41J 2/16* (2006.01)

(52) U.S. Cl.
CPC ..... *B41J 2/14233* (2013.01); *B41J 2/14* (2013.01); *B41J 2/14201* (2013.01); *B41J 2/161* (2013.01); *B41J 2/1607* (2013.01); *B41J 2/1623* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1643* (2013.01); *B41J 2/1646* (2013.01); *B41J 2002/14258* (2013.01)

(58) Field of Classification Search
CPC .. B41J 2/14233; B41J 2/1607; B41J 2/14201; B41J 2002/14258
See application file for complete search history.

(56) References Cited

U.S. PATENT DOCUMENTS

2006/0290747 A1* 12/2006 Shimada ..... B41J 2/14233 347/68
2013/0265370 A1* 10/2013 Nagahata ..... B41J 2/045 347/68

FOREIGN PATENT DOCUMENTS

JP 2007-168110 A 7/2007

OTHER PUBLICATIONS

Nakakubo, U.S. Appl. No. 15/808,140, filed Nov. 9, 2017.

* cited by examiner

*Primary Examiner* — Geoffrey S Mruk
(74) *Attorney, Agent, or Firm* — Venable LLP

(57) ABSTRACT

Liquid ejection head includes a substrate, a piezoelectric element provided on the substrate, an ejection port forming member provided on the substrate carrying the piezoelectric element. The ejection port forming member has an ejection port and forms a pressure chamber with the substrate. A first thin film is arranged between the substrate and the piezoelectric element to produce a space between the substrate and the first thin film. A second thin film is arranged on the piezoelectric element. The first thin film is arranged so as not to contact the lateral (edge) surface of the piezoelectric element and has a higher rigidity than the second thin film.

14 Claims, 8 Drawing Sheets

LIQUID EJECTION HEAD AND METHOD OF MANUFACTURING LIQUID EJECTION HEAD

BACKGROUND OF THE INVENTION

Field of the Invention

This invention relates to a liquid ejection head that ejects liquid from ejection ports by means of piezoelectric elements and also to a method of manufacturing the same.

Description of the Related Art

Liquid ejection heads of the type designed to eject liquid from ejection ports, each being formed at an end of a pressure chamber storing liquid therein, by generating pressure in the inside of the pressure chamber, are more often than not employed in liquid ejection apparatus for recording images on recording mediums by ejecting liquid such as ink. Known techniques for generating pressure in a pressure chamber include a technique of causing the pressure chamber to contract by means of a piezoelectric element. Furthermore, so-called bend mode type liquid ejection heads are known as liquid ejection heads equipped with piezoelectric elements. A bend mode type liquid ejection head has a layered structure formed by laying a piezoelectric element and a vibration plate, of which the piezoelectric element is caused to contract in the in-plane direction by applying a voltage thereto, thereby deforming the vibration plate in the out-of-plane direction (causing bending deformation) to generate pressure in the pressure chamber.

Normally, a liquid ejection head of the above-described type includes a large number of ejection ports. In such a liquid ejection head having a large number of ejection ports, the ejection ports need to be highly densely arranged for the purpose of recording high-resolution images. Japanese Patent Application Laid-Open No. 2007-168110 describes a liquid ejection head manufacturing method that can highly densely arrange ejection ports in a liquid ejection head by way of a high precision processing involving the use of photolithography.

With the manufacturing method described in Japanese Patent Application Laid-Open No. 2007-168110, however, each vibration plate is inevitably held in contact with a lateral (edge) surface of a corresponding piezoelectric element, because sacrificial layers, which are to be removed in a subsequent etching process to produce spaces, are formed on a substrate, piezoelectric elements are then formed on the respective sacrificial layers and thereafter vibration plates are formed on the respective piezoelectric elements. As a result, each vibration plate restricts displacements (due to contractions) of the corresponding piezoelectric element, hence lowering the displacement efficiency, to consequently make it difficult to secure satisfactory displacements for the vibration plate.

SUMMARY OF THE INVENTION

The object of the present invention is to provide a liquid ejection head, particularly in which ejection ports can highly densely be arranged, that can secure satisfactory displacements for the vibration plates thereof and a method of manufacturing such a liquid ejection head.

According to the present invention, the above object is achieved by providing a liquid ejection head including: a substrate; a piezoelectric element provided on the substrate; an ejection port forming member having an ejection port for ejecting liquid, the ejection port forming member being provided on the substrate carrying the piezoelectric element such that a pressure chamber is formed between the ejection port forming member and the substrate to contain the piezoelectric element therein and be held in communication with the ejection port; a first thin film arranged between the substrate and the piezoelectric element such that a space is formed between the substrate and the first thin film; and a second thin film arranged on the piezoelectric element such that the piezoelectric element is sandwiched between the first thin film and the second thin film, wherein the piezoelectric element has a lateral surface and the first thin film is not in contact with the lateral surface, and wherein the first thin film has a first rigidity and the second thin film has a second rigidity, the first rigidity being higher than the second rigidity.

According to the present invention, there is also provided a method of manufacturing a liquid ejection head including: a step of forming a sacrificial layer on a substrate; a step of forming a first thin film on the sacrificial layer, the first thin film having a first rigidity; a step of forming a piezoelectric element on the first thin film; a step of forming a second thin film on the piezoelectric element, the second thin film having a second rigidity lower than the first rigidity; a step of providing an ejection port forming member having an ejection port for ejecting liquid therefrom on the substrate carrying the piezoelectric element such that a pressure chamber is formed between the substrate and the ejection port forming member to contain the piezoelectric element in the inside thereof and be held in communication with the ejection port; and a step of removing the sacrificial layer to produce a space between the substrate and the first thin film.

With a liquid ejection head and a method of manufacturing a liquid ejection head according to the present invention as described above, the first thin film operates as a vibration plate because the first thin film shows a higher rigidity than the second thin film and a piezoelectric element is formed on the first thin film. Thus, the vibration plate is not in contact with the lateral (edge) surface of the piezoelectric element. Therefore, the liquid ejection head can suppress the undesired phenomenon appearing in known liquid ejection heads of the same type that the vibration plate restricts displacements (due to contractions) of the piezoelectric element to reduce the displacement efficiency of the piezoelectric element.

Further features of the present invention will become apparent from the following description of exemplary embodiments with reference to the attached drawings.

DESCRIPTION OF THE EMBODIMENTS

Now, currently preferred embodiments of the present invention will be described below by referring to the accompanying drawings.

First Embodiment

Figure 1A:
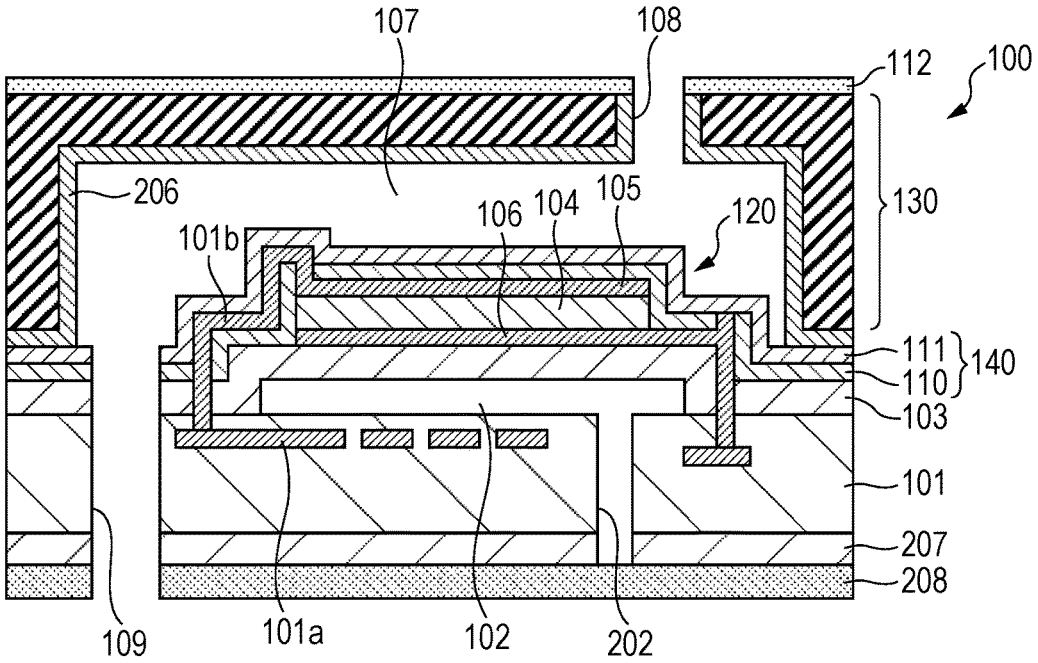
FIGS. 1A and 1B are schematic cross-sectional views of the first embodiment of liquid ejection head according to the present invention.
Figure 1B:
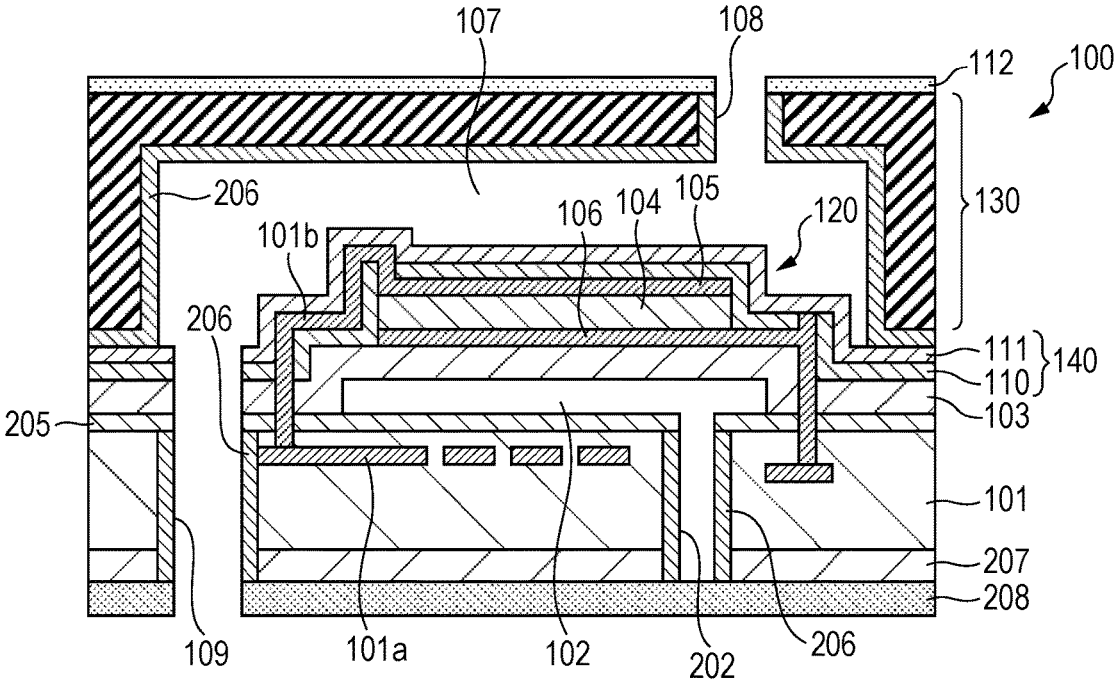
Figure 2:
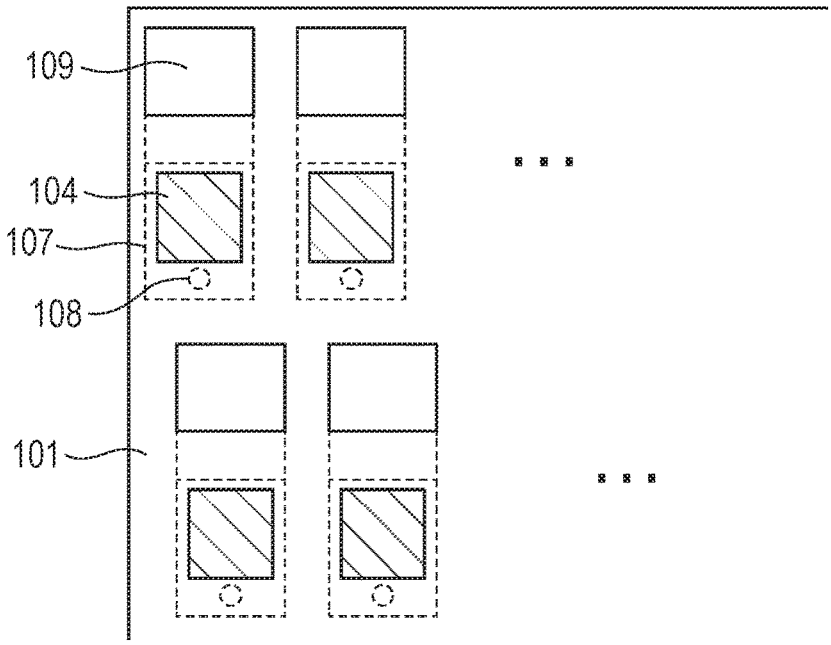
FIG. 2 is a schematic plan view of the first embodiment of liquid ejection head according to the present invention.
Figure 3A:
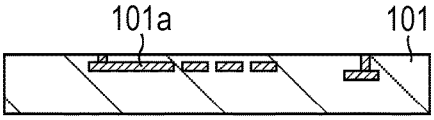
FIGS. 3A, 3B, 3C, 3D, 3E, 3F, 3G, 3H, 3I, 3J, 3K and 3L are schematic cross-sectional views of the first embodiment of liquid ejection head according to the present invention, illustrating different steps of the method of manufacturing the liquid ejection head.
Figure 3B:
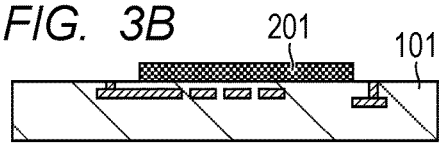
Figure 3C:
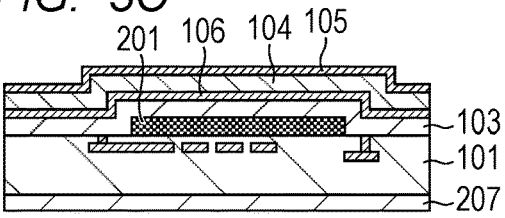
Figure 3D:
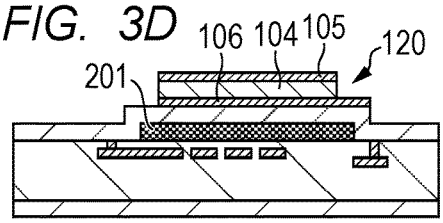
Figure 3E:
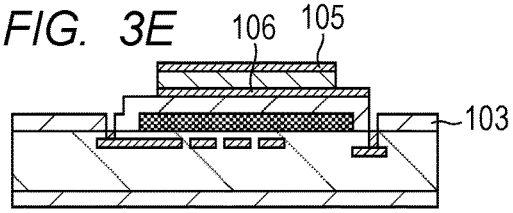
Figure 3F:
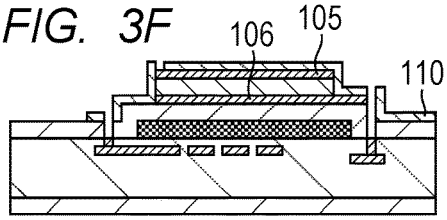
Figure 3G:
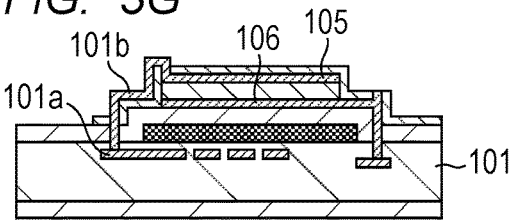
Figure 3H:
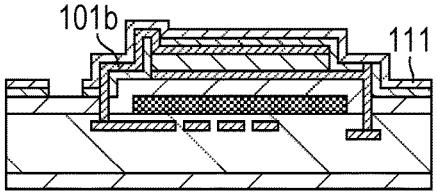
Figure 3I:
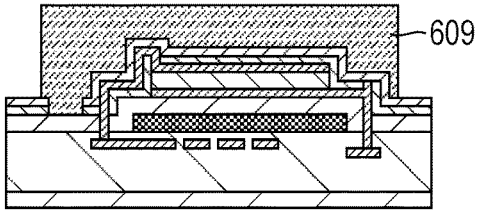
Figure 3J:
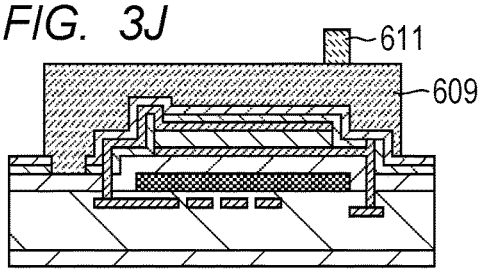
Figure 3K:
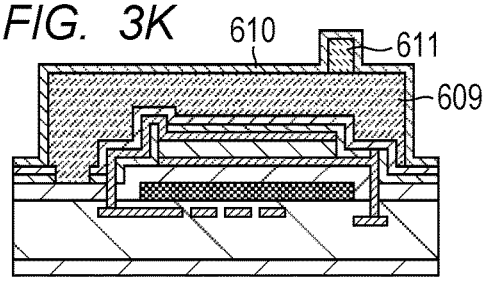
Figure 3L:
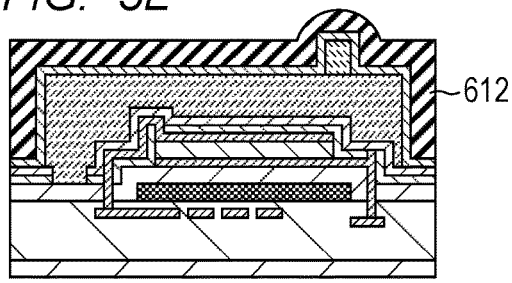
Figure 4A:
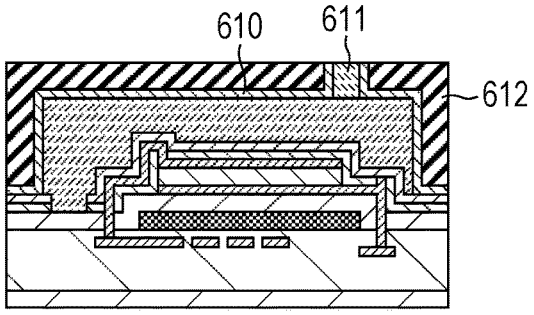
FIGS. 4A, 4B, 4C, 4D, 4E and 4F are schematic cross-sectional views of the first embodiment of liquid ejection head according to the present invention, illustrating different steps of the method of manufacturing the liquid ejection head.
Figure 4E:
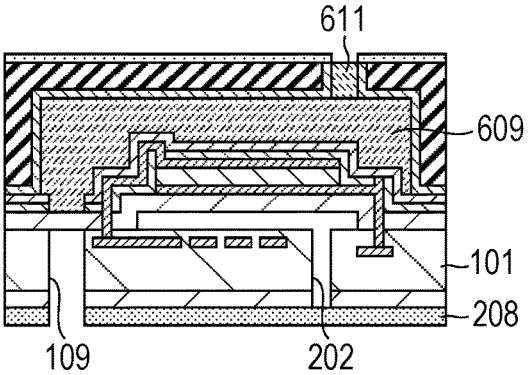
Figure 4B:
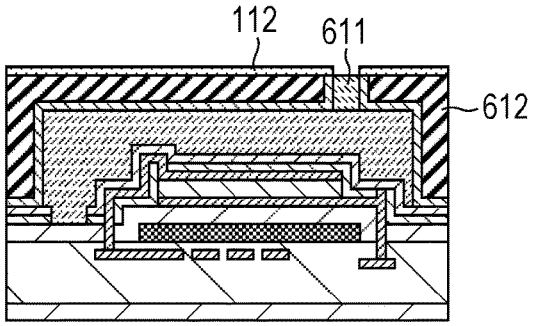
Figure 4F:
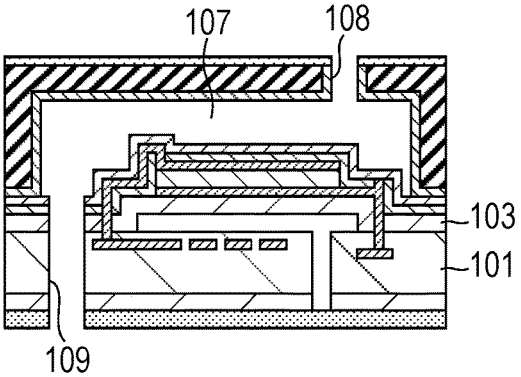
Figure 4C:
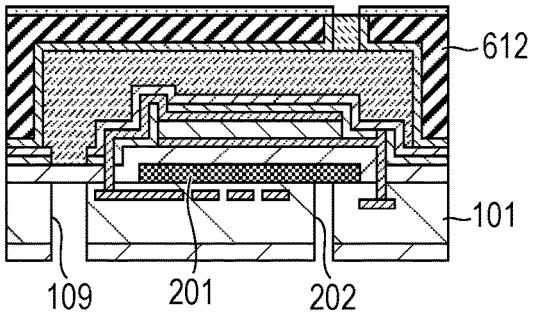
Figure 4D:
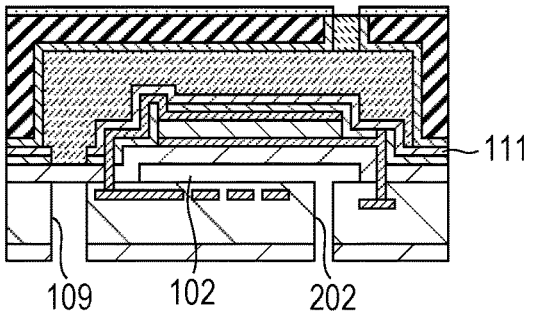

The first embodiment of liquid ejection head according to the present invention will be described by referring to FIGS. 1A, 1B and 2. FIG. 1A is a schematic cross-sectional view of this embodiment of liquid ejection head and FIG. 1B is a schematic cross-sectional view of a liquid ejection head obtained by modifying this embodiment. FIG. 2 is a schematic plan view of this embodiment of liquid ejection head.

Referring to FIG. 1A that illustrates a part of the first embodiment of liquid ejection head 100, there are shown a substrate 101, a piezoelectric element 120, an ejection port forming member 130, a first thin film 103 and a second thin film 140 that the liquid ejection head 100 includes. The piezoelectric element 120 is arranged above the substrate 101 and includes a piezoelectric body 104, an upper electrode 105 and a lower electrode 106. The lower electrode 106, the piezoelectric body 104 and the upper electrode 105 are sequentially laid one on the other in the above-mentioned order in the thickness direction of the substrate 101. The ejection port forming member 130 is arranged at the surface side of the substrate 101 where the piezoelectric element 120 is located and has an ejection port 108 for ejecting liquid such as ink. The ejection port forming member 130 defines a pressure chamber 107 between itself and the substrate 101, which pressure chamber 107 is held in communication with the ejection port 108 and contains the piezoelectric element 120 in the inside thereof. A supply port 109 for supplying liquid to the pressure chamber 107 is cut through the substrate 101 and held in communication with the pressure chamber 107.

The first thin film 103 is arranged between the substrate 101 and the piezoelectric element 120 and defines a space 102 formed between itself and the substrate 101. As will be described in greater detail hereinafter, the first thin film 103 operates as vibration plate for generating pressure in the inside of the pressure chamber 107 and the space 102 is provided so as to allow the first thin film 103, which operates as vibration plate, to be displaced. More specifically, as the piezoelectric element 120 is driven to operate, the first thin film 103 that operates as vibration plate is displaced and then, as a result, pressure is generated in the pressure chamber 107. Thus, the generated pressure forces the liquid in the inside of the pressure chamber 107 to be ejected from the ejection port 108. Normally, a liquid ejection head has a large number of ejection ports and, to realize high resolution image recording, preferably the liquid ejecting operation of each ejection port 108 can be controlled independently. For this purpose, while the first thin film 103 that operates as vibration plate may be shared by the large number of pressure chambers 107, preferably each pressure chamber 107 is equipped with a first thin film 103 that is independent from all the other first thin films 103. The second thin film 140 includes two protection films 110 and 111 and operates as protection film for the piezoelectric element 120.

In addition to the above-described supply port 109, a communication hole 202 is also formed through the substrate 101 so as to be held in communication with the space 102. The communication hole 202 communicates with the space 102 by way of an aperture area smaller than the area of the bottom surface of the space 102 (the surface portion of the substrate 101 that faces the space 102). As will be described hereinafter, the communication hole 202 is employed as etching hole in the etching process for forming the space 102. An occlusion layer 208 is arranged at the side of the substrate 101 opposite to the side thereof where the piezoelectric element 120 is arranged so as to occlude the communication hole 202 at the lower end thereof. With this arrangement, the space 102 can be held out of communication with the supply port 109 through which liquid flows and also with the pressure chamber 107. A substrate protection film (a third thin film) 205 may be arranged between the substrate 101 and the first thin film 103, or between the substrate 101 and the space 102 to be more accurate, in order to protect the substrate 101 in the above-described etching process. Similarly, an inner wall protection film (a fourth thin film) 206 as shown in FIG. 1B may be arranged on the inner wall of the supply port 109 and also on the inner wall of the communication hole 202 in order to protect the supply port 109 and the communication hole 202 against etchant.

Referring to FIG. 2, pressure chambers 107 are arranged so as to produce a matrix-like pattern. Accordingly, ejection ports 108 are also arranged so as to produce a matrix-like pattern. In other words, ejection ports 108 are arranged in rows. Now, the plane dimensions of each ejection port in an instance where ejection ports 108 are arranged at a pitch of 150 dpi (about 169 μm) in each row of ejection ports and any two adjacently located rows of ejection ports 108 are displaced by 1,200 dpi (about 21 μm) from each other in the direction perpendicular to the rows will be described below.

If the plane dimensions of a pressure chamber 107 are 120 μm×210 μm, the wall that separates two adjacently located pressure chambers 107 in each row of ejection ports has a width of about 49 μm. Then, the displaceable region of a piezoelectric element 120 that is determined by the corresponding space 102 will be slightly smaller than the plane dimensions of a pressure chamber 107 and may be made to be 115 μm×200 μm. The volume change of a pressure chamber 107 that can be produced by a piezoelectric element 120 having such a displaceable region (volume change per applied unit voltage) is about 0.26 pL/V. Therefore, if the drive voltage is 25 V, a volume change of about 6.5 pL will be produced so that liquid of about 4 pL can be ejected. If cross talks need to be controllable and a satisfactory liquid refill performance needs to be achievable, the plane dimensions of a supply port 109 are about 120 μm×80 μm. If two adjacently located ejection ports are separated from each other by a gap of 350 μm, the wall between them may show a width of 30 μm.

Now, the method of manufacturing the liquid ejection head of this embodiment will be described below by referring to FIGS. 3A through 3L and 4A through 4F. Note that each of FIGS. 3A through 3L and 4A through 4F shows a schematic cross-sectional view of the liquid ejection head in the corresponding manufacturing step of this method of manufacturing the liquid ejection head. Also note that the steps (3*a*) through (3*l*) that will be described below respectively correspond to FIGS. 3A through 3L, while the steps (4*a*) through (4*f*) that will be described below respectively correspond to FIGS. 4A through 4F.

(3*a*) As substrate 101, a substrate that is made of silicon (Si) is brought in. The substrate 101 has a wiring layer 101*a* formed therein in advance for each piezoelectric element. Wiring materials that can be used for the wiring layer 101*a* typically include aluminum (Al), aluminum compounds and tungsten (W). While the use of Al can reduce the electric resistance of the wiring, the use of W is more preferable if a high temperature process is to be executed on the wiring after the formation of the wiring layer. While part of the surface of the wiring 101*a* may be exposed in order to electrically connect the lead-out wire of the upper electrode 105 and that of the lower electrode 106 to the exposed part of the wiring 101*a*, the rest of the surface of the wiring 101*a* may be covered and protected by means of SiN or $SiO_2$. The wiring layer 101*a* may include therein integrated circuits such as CMOSs (complementary metal oxide semiconductors) in order to reduce the number of wirings to be used there. The CMOSs may be made to have a feature among others of forming switches for activating/deactivating an ejection signal in response to the image data applied to the liquid ejection head.

(3*b*) A sacrificial layer 201 is formed on the substrate 101 by means of photolithography. In view of that the sacrificial layer 201 is removed in a later etching process, a material that shows a high degree of etching selectivity relative to the member surrounding the sacrificial layer 201 and also shows a high etching rate may preferably be employed for the sacrificial layer 201. Possible combinations of a sacrificial layer 201, a surrounding member and an etchant include the followings. In a first possible combination, the sacrificial layer 201 and the surrounding member are respectively made of Al and Si, and an Al wet etchant is employed for the etchant. In a second possible combination, the sacrificial layer 201 and the surrounding member are respectively made of $SiO_2$ and Si, and HF is employed for the etchant. Note that the use of vapor HF for the etchant provides an advantage that the etching process can be executed efficiently even when the sacrificial layer 201 is a narrow one. Also note that, when both the sacrificial layer 201 and the other member are made of $SiO_2$, the surface of the other member needs to be protected in advance. In a third possible combination, the sacrificial layer 201 and the surrounding member are respectively made of Si and $SiO_2$, and $XeF_2$ (dry etching) is employed for the etchant. Note that this combination requires a substrate protection film 205 to be formed on the substrate 101 prior to the formation of the sacrificial layer 201 in order to protect the Si-made substrate 101 as shown in FIG. 1B. There may be other possible combinations provided that a certain degree of etching selectivity is secured for such combinations.

If the range of displacement of the piezoelectric element 120 is about several hundred nanometers, the thickness of the sacrificial layer 201 is preferably not less than 500 nm and not more than 1,500 nm. This is because, as the thickness of the sacrificial layer 201 is made greater, the piezoelectric element 120 becomes to show a cross-sectional view having a higher step. The plane dimensions of the sacrificial layer 201 are made to show appropriate values that vary as a function of the liquid ejection rate, the liquid ejection frequency and the layout of the ejection ports 108. When, for example, liquid droplets of about 4 pL are to be ejected at a frequency of about 100 kHz, plane dimensions of about 115 μm×200 μm are selected for the sacrificial layer 201 if ejection ports 108 are arranged at a pitch of 150 dpi as in the instance of this embodiment, while plan dimensions of about 80 μm×500 μm are selected for the sacrificial layer 201 if ejection ports 108 are arranged at a pitch of 200 dpi.

(3*c*) First thin film 103 that operates as vibration plate is formed on the substrate 101 and the sacrificial layer 201. The first thin film 103 is typically made of SiN and shows a film thickness of between about 500 nm and about 2,000 nm. Methods that can be used for forming the first thin film 103 include the plasma excitation chemical vapor deposition (PE-CVD) method and the low pressure chemical vapor deposition (LP-CVD) method. While a highly dense film can be formed with low stress, which is very suitable for a vibration plate, when the LP-CVD method is employed, the PE-CVD method may more preferably be employed to reduce the film forming temperature if the substrate 101 includes integrated circuits therein.

Alternatively, $SiO_2$ may be used to form the first thin film 103. Then, the PE-CVD method may preferably be employed for forming the first thin film 103. Still alternatively, Si may be used to form the first thin film 103. Besides, the first thin film 103 may not necessarily be a single film and it may alternatively be a multilayer film formed by using a plurality of materials. For example, the first thin film 103 may be a two-layered film having an SiN-made first layer and an $SiO_2$-made second layer. The materials to be used for forming such a multilayer film may appropriately be selected by taking the internal stress, the adhesiveness, the etching selectivity relative to the other processes involved in the manufacturing method and other factors of each of the component layers into consideration.

Additionally, a substrate protection film 207 is formed on the surface of the substrate 101 opposite to the surface where the first thin film 103 is formed by using the material same as that of the first thin film 103. Furthermore, a lower electrode 106, a piezoelectric body 104 and an upper electrode 105 are formed sequentially on the first thin film 103 in the above-mentioned order.

A Pt film having a thickness between about 50 nm and about 150 nm may be formed by sputtering for the lower electrode 106. An adhesion layer typically made of Ti, $TiO_2$, ZrO, SrO, LNO or the like and having a thickness between about 1 nm and about 50 nm may be formed between the first thin film 103 and the lower electrode 106 in order to improve the adhesiveness of the lower electrode 106 relative to the first thin film 103.

Lead zirconate titanate (PZT), niobium (Nb)-doped PZT or some other appropriate material is employed for the piezoelectric body 104. While the sol-gel method is popularly employed for forming a piezoelectric body 104, a low film forming temperature needs to be adopted to form the piezoelectric body 104 when the substrate 101 includes integrated circuits therein because the film forming process and a subsequent thermal annealing process need to be conducted at a temperature not higher than about 500° C. If such is the case, a low temperature sputtering method, a pulse laser deposition (PLD) method, a transfer method or the like is appropriately employed for the film forming process. Particularly, the use of a sputtering method is preferable because it can produce a piezoelectric body that shows a high degree of crystallinity and a high withstand voltage and hence can suitably be employed for a liquid ejection head. The appropriate thickness of the piezoelectric body 104 is between 500 nm and 3,000 nm. An adhesion layer typically made of Ti, $TiO_2$, ZrO, SrO, LNO or the like and having a thickness between about 1 nm and about 5 nm may be formed between the lower electrode 106 and the piezoelectric body 104 in order to improve the crystal orientation and the adhesiveness of piezoelectric body 104.

The upper electrode 105 may be formed to show a thickness between about 50 nm and about 150 nm typically by using Pt, IrO, RuO, TiW or the like. A sputtering method is preferably employed to form the upper electrode. An adhesion layer typically made of Ti, $TiO_2$, ZrO, SrO, LNO or the like and having a thickness between about 1 nm and about 5 nm may be formed between the piezoelectric body 104 and the upper electrode 105 in order to improve the adhesiveness of the upper electrode 105 relative to the piezoelectric body 104.

(3*d*) The upper electrode 105, the piezoelectric body 104 and the lower electrode 106 are subjected to a patterning process by means of photolithography to produce a piezoelectric element 120. While either wet etching or dry etching may be employed for the etching operation in the patterning process, the use of dry etching is preferable because the piezoelectric body 104 is less subject to process damage and the side etching phenomenon can be reduced when dry etching is employed. After patterning the upper electrode 105, the patterned upper electrode 105 can be used as hard mask at the time of etching the piezoelectric body 104. The displacement efficiency of the piezoelectric element 120 can be improved by making the width of the short sides of the piezoelectric body 104 smaller than the width of the short sides of the sacrificial layer 201 by about 2 to 6 μm at the time of the patterning operation.

(3*e*) Through holes are formed respectively for the lead-out wire from the upper electrode 105 and the lead-out wire from the lower electrode 106 by patterning the first thin film 103 by means of photolithography. Dry etching can be used for the operation of patterning the first thin film 103.

(3*f*) A first protection film 110 is formed as the first layer of second thin film 140 and then through holes are formed through the first protection film 110 for the lead-out wires by patterning the first protection film 110. The first protection film 110 needs to be formed by using an insulating material in order to electrically insulate the lead-out wire from the upper electrode 105 against the lower electrode 106. Such a first protection film 110 is typically formed by using an $SiO_2$ film prepared by means of tetraethoxysilane (TEOS)-CVD and such an $SiO_2$ film can be formed at a low temperature. The first protection film 110 preferably has a thickness between 100 nm and 300 nm. Dry etching is preferably employed for the patterning operation.

(3*g*) A film of Al or an Al compound having a thickness between about 500 nm and about 1,000 nm is formed typically by sputtering and then lead-out wire 101*b* for connecting the upper electrode 105 and the lower electrode 106 to the wiring layer 101*a* on the substrate 101 is formed by patterning the film. Either dry etching or wet etching can be used for the patterning operation.

(3*h*) A second protection film 111 is formed as the second layer of the second thin film 140 to protect the lead-out wire 101*b* and a through hole that is to be held in communication with supply port 109, which is to be formed in a later step, by patterning the second protection film 111. Dry etching is employed for the patterning operation. The second protection film 111 needs to be formed by using an insulating material in order to insulate the wire 101*b* against liquid such as ink. Additionally, the second protection film 111 is required to be durable against liquid. Examples of films that can be used as the second protection film 111 include $SiO_2$ film formed by means of TEOS-CVD that allows the film to be formed at a low temperature, SiN film formed by means of PE-CVD and oxide film formed by means of atomic layer deposition (ALD). The second protection film 111 preferably has a film thickness between 100 nm and 300 nm. However, when oxide film formed by means of ALD is employed for the second protection film 111, the thickness of the oxide film may well be about several nanometers because the obtained film is a conformal film.

(3*i*) First mold material 609 is prepared in order to form pressure chamber 107, which is to be produced by removing the first mold material 609 in a post process. While techniques that can be used for forming the first mold material 609 include printing and photolithography, the use of photolithography that utilizes photosensitive resin is preferable from the viewpoint of forming a micro-pattern. The first mold material 609 is preferably a material that allows a patterning operation to be successfully executed even if the prepared material shows a large film thickness and can be removed by means of an alkali solution or an organic solvent in a post process. Examples of materials that can be used for the first mold material 609 include THB Series (tradename, available from JSR) and PMER Series (tradename, available from Tokyo Ohka Kogyo). Alternatively, the first mold material 609 can be formed by laminating photosensitive dry films obtained by way of a film forming process. The mold material can be made to show a large thickness by using dry film. Then, as a result, the flow resistance of the pressure chamber 107 can be reduced so that liquid refill operation can be conducted smoothly and quickly to raise the ejection frequency. The first mold material 609 preferably shows a thickness between 20 μm and 60 μm.

(3*j*) Second mold material 611 is formed on the first mold material 609 in order to produce ejection port 108 by removing the second mold material 611 in a post process. Examples of materials that can be used for the second mold material 611 include THB Series (tradename, available from JSR) and PMER Series (tradename, available from Tokyo Ohka Kogyo), although materials other than the above listed ones can be used for the second mold material 611 provided that a patterning operation can be conducted on such a material even if it has a large thickness and the second mold material 611 formed by using such a material can be removed by means of an alkali solution or an organic solvent in a post process.

(3*k*) Electro-conductive layer 610 of a material selected from Pt, Au, Cu, Ni and Ti is formed on the first mold material 609 and also on the second mold material 611 typically by means of sputtering. The electro-conductive layer 610 preferably shows a thickness of not less than 50 nm.

(3*l*) Coating layer 612 that is to be turned into ejection port forming member 130 is formed by way of a plating process. Plating techniques that can be used to form the coating layer 612 include electroplating and electroless plating, which may appropriately and selectively be used, although electroplating is employed here to form an Ni-made coating layer 612. Electroplating provides an advantage that it is less costly and the waste solution produced as a result of the plating process can be treated with ease. On the other hand, electroless plating provides an advantage that it can form uniform film because of its excellent deposition effect and the obtained plating film is hard and abrasion-resistant. The coating layer 612 preferably shows a thickness between 10 μm and 30 μm.

(4*a*) The surface of the coating layer 612 is polished and planarized. More specifically, the coating layer 612 and the electro-conductive layer 610 are polished until they are removed and the second mold material 611 is exposed.

(4*b*) Thin Ni-polytetrafluoroethylene (PTFE) composite plating layer is formed on the coating layer 612 as water repellent film 112 by means of electroplating. Since the electro-conductive layer 610 no longer exists on the exposed second mold material 611 at this time, no Ni-PTFE layer is formed there.

(4*c*) A tape that can be removed in a post process is bonded to the surface side of the substrate 101 where the coating layer 612 has been formed or to the supporting substrate in order to protect the surface from any etchant. Then, a deep penetration reactive ion etching (D-RIE) operation is conducted on the substrate 101 from the side of the surface opposite to the surface side where the tape has been bonded to form a supply port 109 and an etching hole (communication hole) 202 in the substrate 101. More specifically, the etching hole 202 is formed so as to run through the substrate 101 and becomes to be in communication with an end of the sacrificial layer 201 with an aperture area smaller than the area of the bottom surface (the region facing the substrate 101) of the sacrificial layer 201. Then, as a result, most of the region of the substrate 101 that faces the sacrificial layer 201 can effectively be utilized as space for arranging wires and integrated circuits so that ejection ports 108 can highly densely be arranged there. The aperture diameter of the supply port 109 is preferably between about 60 μm and about 120 μm (80 μm×120 μm in the instance of arrangement of ejection ports 108 shown in FIG. 2) and the aperture diameter of the etching hole 202 is preferably between about 10 μm and about 100 μm.

(4*d*) The sacrificial layer 201 is removed by etching and space 102 is produced there. As described above, the specific etching technique to be used to remove the sacrificial layer 201 may appropriately be selected according to the material of the sacrificial layer 201. When Si is used for the sacrificial layer 201, inner wall protection film 206 that is typically made of $SiO_2$ is formed in advance on the inner wall of the supply port 109 and that of the etching hole 202 as shown in FIG. 1B in order to protect the substrate 101 from the etchant to be used for the etching operation. The TEOS-CVD method that can form film at a low temperature may suitably be used to form the protection film 206. After forming the film, the $SiO_2$ film that has been formed on the bottom of the etching hole 202 can selectively be removed by means of dry etching and application of a bias voltage. When, additionally, $SiO_2$ is used for the sacrificial layer 201, the second protection film 111 needs to be formed by using a material other than $SiO_2$ such as SiN or the supply port 109 needs to be temporarily closed and sealed before the etching operation.

(4*e*) The etching hole 202 is sealed (closed). A technique of arranging an occlusion layer 208 for closing the etching hole 202 on the surface of the substrate 101 where the open end of the etching hole 202 is found can be employed to seal the etching hole 202. With such a technique, more specifically, the etching hole 202 is formed as a plurality of microholes of a diameter of not greater than 1 μm in advance and then a layer 208 that is typically made of $SiO_2$ or SiN is formed on the surface of the substrate 101 where the etching hole 202 opens to close the microholes. Alternatively, a technique of closing the etching hole 202 by bonding the substrate 101 with another substrate 208 having only an opening at a position that corresponds to the supply port 109 can be employed.

(4*f*) The part of the first thin film 103 that faces the supply port 109 is removed by dry etching from the side of the surface of the substrate 101 where the supply port 109 opens. Then, the first mold material 609 and the second mold material 611 are removed by means of alkali solution or an organic solvent to produce the pressure chamber 107 and the ejection port 108. As a result of executing the above-described steps, a finished liquid ejection head 100 as shown in FIG. 1A is produced.

While the space 102 is produced by forming a vibration plate (first thin film) 103 on the sacrificial layer 201 and subsequently removing the sacrificial layer 201 in this embodiment, the method of forming the space 102 is not limited to the above-described one. For example, the space 102 can alternatively be formed by forming a structure member on the substrate 101 except the area where the space 102 is to be formed in a later stage and bonding a vibration plate 103 onto the structure member. The operation of bonding a vibration plate 103 to the structure member is preferably conducted in vacuum in order to minimize the deformation that can take place due to the expansion of the air in the space 102 that arises in a later heating process. Note that the technique of forming a vibration plate 103 on the sacrificial layer 201 as described for this embodiment is suitable because a thin vibration plate 103 and hence a smaller pressure chamber 107 can be formed with this technique.

The rigidity of the piezoelectric element 120 of this embodiment and possible displacements thereof will be described here by referring to FIG. 1A once again. When a voltage is applied between the upper electrode 105 and the lower electrode 106, the piezoelectric body 104 tends to expand in a direction running in parallel with the applied electric field and contract in the direction perpendicular to the applied electric field. However, such a behavior of the piezoelectric body 104 is restricted at one of the surfaces thereof by the lower electrode 106 and the first thin film 103, at the other surface by the upper electrode 105 and the second thin film 140 and additionally at the lateral surfaces thereof by the second thin film 140. As the movement of the piezoelectric body 104 is limited due to those restrictions that are balanced by the contracting force of the piezoelectric body 104, deflection occurs to the first thin film 103, the piezoelectric element 120 and the second thin film 140 to give rise to changes in the capacity of the pressure chamber 107 that are necessary for the liquid ejection head to eject liquid.

At this time, the first thin film 103 of this embodiment can be made to operate as vibration plate by making the rigidity of the first thin film 103 greater than that of the second thin film 140. Then, the pressure chamber 107 can be made to be displaced to expand when a voltage is applied to the piezoelectric element 120. Additionally, as the rigidity of the first thin film 103 is raised, the second thin film 140 whose rigidity is lower than the rigidity of the first thin film 103 comes to contact the lateral surface of the piezoelectric body 104. Then, as a result, the positional restriction to the lateral surface sides of the piezoelectric body 104 and the surface side of the piezoelectric body 104 that faces the pressure chamber 107 can be reduced to raise the displacement efficiency of the piezoelectric element 120 so that the first thin film 103 operating as vibration plate is allowed to show a large displacement.

Techniques that can be used to raise the rigidity of the first thin film 103 include forming the first thin film 103 by using a material showing a high Young's modulus and forming the first thin film 103 to make it show a relatively large thickness. The rigidity of the second thin film 140 can be reduced by using any of the above techniques in the opposite direction. Materials showing a relatively high Young's modulus include SiN, whereas materials showing a relatively low Young's modulus include $SiO_2$. If, for example, the piezoelectric body 104 is 2 μm thick and the SiN-made first thin film 103 is 800 nm thick, the first thin film 103 can be made to show a rigidity that is higher than the rigidity of the second thin film 140 by forming the second thin film 140 in a manner as described below. Namely, the first layer 110 of the second thin film 140 is formed to show a thickness of 300 nm by using $SiO_2$ and the second layer 111 is formed to show a thickness of 200 nm. Then, the first thin film 103 shows a rigidity that is higher than the rigidity of the second thin film 140. With the above-described arrangement, the piezoelectric element 120 can be displaced about 30 times greater if compared with an instance where the rigidity of the first thin film 103 is made to be lower than the rigidity of the second thin film 140. Additionally, the first thin film 103 can be made to have a two-layered structure, in which the first layer may be formed to show a thickness of 600 nm by using SiN and the second layer may be formed to show a thickness of 400 nm by using $SiO_2$. While the rigidity of the upper electrode 105 and that of the lower electrode 106 also affect the displacement of the vibration plate, their influence is relatively small because the rigidity of a flat plate is proportional to the cube of the thickness of the flat plate. More specifically, the thickness of the upper electrode 105 and that of the lower electrode 106 are between 50 and 150 nm, which are sufficiently smaller than the thickness of the first thin film 103 that is between 800 nm and 1,000 nm and hence the influence of the rigidity of the upper electrode 105 and that of the lower electrode 106 on the displacement of the vibration plate is small and negligible.

Second Embodiment

Figure 5:
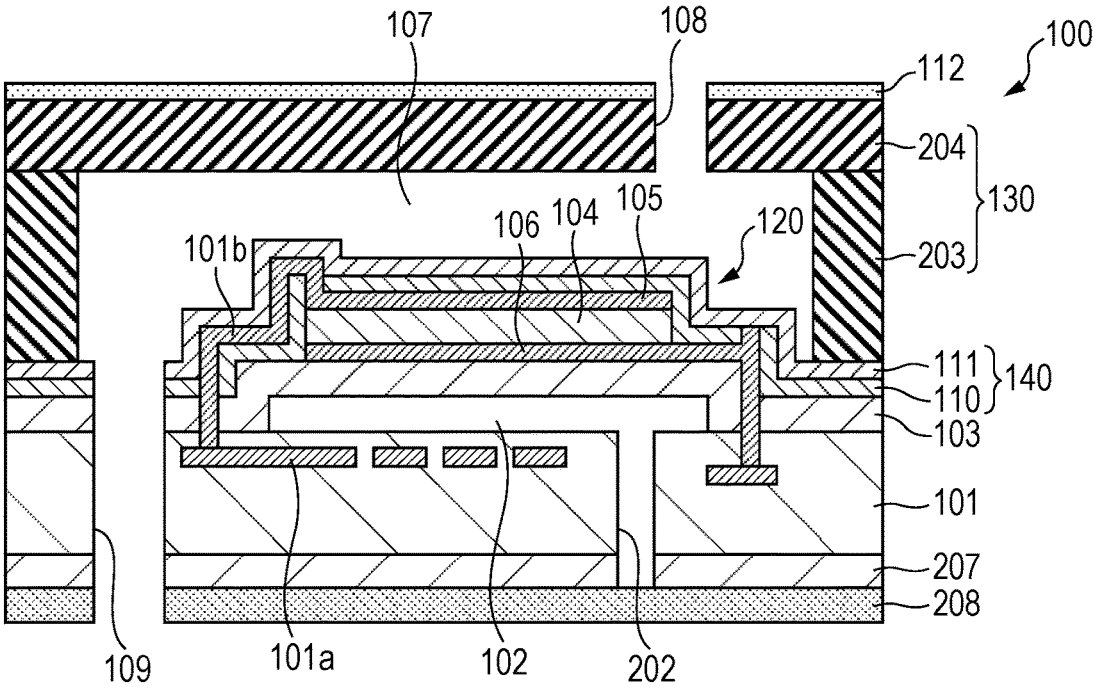
FIG. 5 is a schematic cross-sectional view of the second embodiment of liquid ejection head according to the present invention.
Figure 6A:
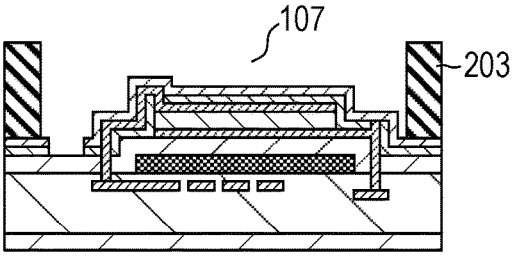
FIGS. 6A, 6B, 6C, 6D, 6E, 6F and 6G are schematic cross-sectional views of the second embodiment of liquid ejection head according to the present invention, illustrating different steps of the method of manufacturing the liquid ejection head.
Figure 6B:
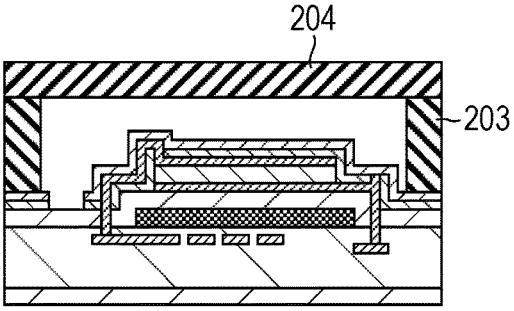
Figure 6C:
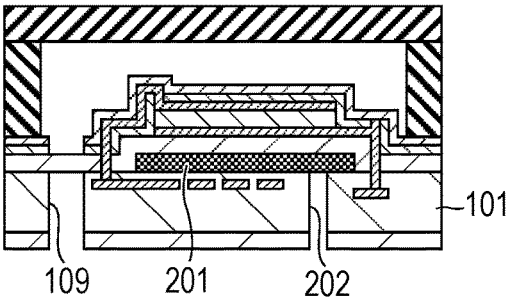
Figure 6D:
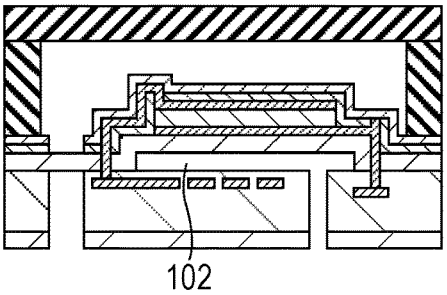
Figure 6E:
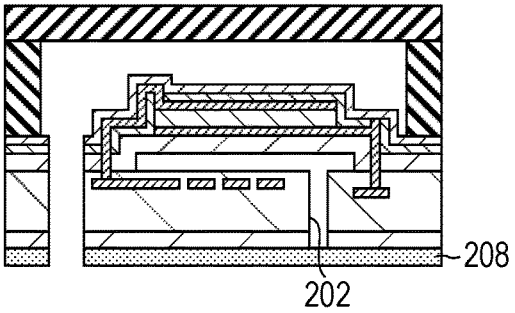
Figure 6F:
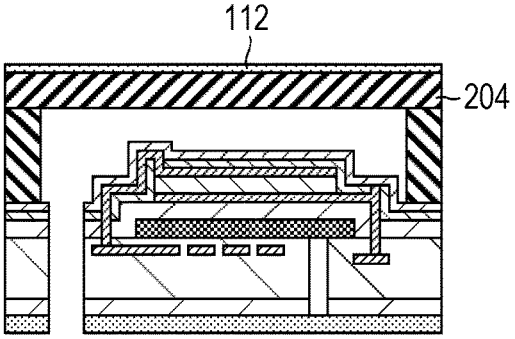
Figure 6G:
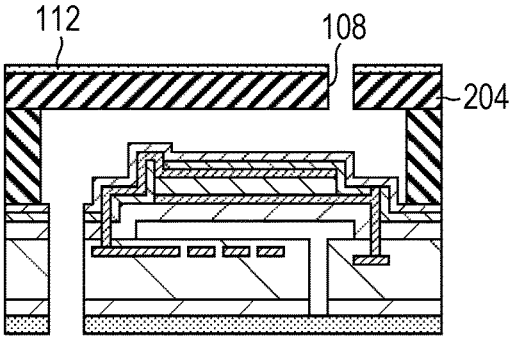

FIG. 5 is a schematic cross-sectional view of the second embodiment of liquid ejection head according to the present invention, showing an exemplar configuration thereof. This embodiment differs from the first embodiment in terms of the configuration of the ejection port forming member 130. More specifically, unlike the ejection port forming member of the first embodiment, the ejection port forming member 130 of this embodiment is formed by using two members 203 and 204. One of the members, or the first member 203, has pressure chambers 107 and is made of a resin material, whereas the other member, or the second member 204, has ejection ports 108 and is made of an inorganic material. Otherwise, the second embodiment has a configuration same as that of the first embodiment.

The method of manufacturing the liquid ejection head of this embodiment will now be described below by referring to FIGS. 6A through 6G. FIGS. 6A through 6G are schematic cross-sectional views of the second embodiment of liquid ejection head according to the invention in different steps of the method of manufacturing the liquid ejection head. Note that Steps (6*a*) through (6*g*) as described below respectively correspond to FIGS. 6A through 6B. In the manufacturing method of this embodiment, the steps down to Step (6*a*) are the same as the steps of the manufacturing method of the first embodiment down to Step (3*h*) and hence those steps will not be described below.

(6*a*) First member 203 having pressure chamber 107 is formed by laminating photosensitive dry films and patterning the laminated dry films. The first member 203 is preferably made to show a thickness between 20 μm and 60 μm.

(6*b*) Second member 204 that is made of Si is bonded to the first member 203 and polished to make it show a desired thickness. The appropriate thickness of the second member 204 is between about 10 μm and about 30 μm, although it depends on the diameter of ejection port 108 that will be formed in a subsequent step. Techniques that can be used to bond the first member 203 and the second member 204 together include bonding them by means of an adhesive agent, bonding them together by applying pressure and heat to the first member 203, which is made of dry films, in order to cure the first member 203.

(6*c*) Supply port 109 and etching hole (communication hole) 202 are formed in the substrate 101 by following the operation sequence same as that of Step (4*c*) of the first embodiment under the conditions same as those of Step (4*c*) of the first embodiment.

(6*d*) The sacrificial layer 201 is removed to produce space 102 by following the operation sequence same as that of Step (4*d*) of the first embodiment under the conditions same as those of Step (4*d*) of the first embodiment.

{6*e*} The etching hole 202 is sealed (closed) by means of occlusion layer 208 by following the operation sequence same as that of Step (4*e*) of the first embodiment under the conditions same as those of Step (4*e*) of the first embodiment.

After this step or Step (6*a*), a step of forming a protection film may be executed in order to protect various members of the embodiment from liquid such as ink. Film that can suitably be formed as protection film may be $SiO_2$ film that is formed by means of TEOS-CVD or TaO film formed by means of ALD.

(6*f*) Water repellent film 112 is formed on the second member 204. Materials that can be used to form the water repellent film 112 include a fluorine-based or silane-based coupling agent. Methods that can be used to form the water repellent film 112 include a vapor deposition method.

(6*g*) Ejection port 108 is formed in the second member 204 by means of photolithography and D-RIE. The operation of forming liquid ejection head 100 of this embodiment as shown in FIG. 5 is completed in this way.

Note here that, if an attempt of applying photoresist to the water repellent film 112 is made, the water repellent film 112 repels photoresist. For this reason, a mask obtained by laminating photosensitive dry films is preferably employed at the time of photolithography operation. Alternatively, the surface of the water repellent film 112 may be turned to water non-repellent by forming a film of Ti or the like that protects the water repellent film 112 on the water repellent film 112 and photoresist may be applied to the surface of the protection film before executing the photolithography operation. Subsequently, the resist is removed and thereafter the water-repellent protection film is removed.

This embodiment provides the following advantages in addition to the advantages of the first embodiment. Namely, the height of the lateral wall of the pressure chamber 107 can be made relatively low so as to be between 20 μm and 60 μm. Additionally, the width of the wall separating any two adjacently located pressure chambers 107 can be made to be not smaller than 30 μm. Thus, if photosensitive dry film, which is made of organic resin showing a low Young's modulus, is employed for the first member 203, cross talks attributable to wall deformations and consumption of ejection energy can satisfactorily be reduced. Additionally, since Si that shows a high Young' modulus is employed for the second member 204, any possible collapse of the walls of the first member 203 can be suppressed and, at the same time, consumption of ejection energy due to deformation of the surface of the second member 204 where the ejection port 108 opens can satisfactorily be reduced.

Furthermore, with the manufacturing method of this embodiment, the photosensitive resin for forming the ejection port 108 is exposed to light, developed and then subjected to a patterning operation after bonding both the first member 203, which is made of photosensitive film, and the second member 204, which is made of Si, to the substrate 101. Therefore, the accuracy of alignment of the first member 203 and the second member 204 that are bonded to each other does not affect the positional accuracy of each of the component members of the liquid ejection head 100 so that the liquid ejection head 100 can be accurately manufactured. so as to make it show a high degree of precision. Then, variances of liquid ejection can be minimized and ejection ports 108 can be arranged highly densely.

Third Embodiment

Figure 7A:
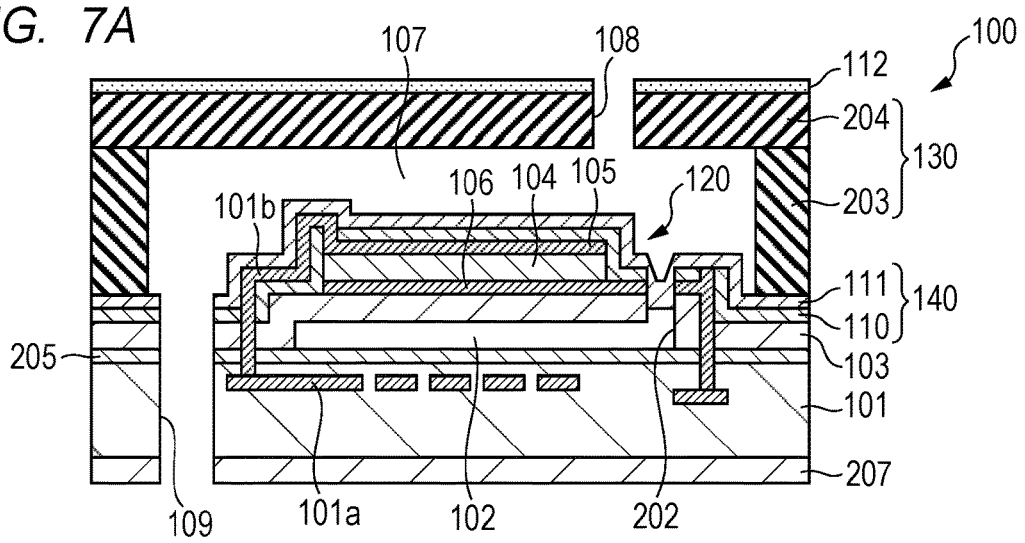
FIGS. 7A, 7B and 7C are schematic cross-sectional views of the third embodiment of liquid ejection head according to the present invention.

An exemplary configuration of the third embodiment of liquid ejection head according to the present invention will now be described below by referring to FIGS. 7A and 7B. FIG. 7A is a schematic cross-sectional view of the liquid ejection head of this embodiment and FIGS. 7B and 7C are schematic cross-sectional views of liquid ejection heads obtained by modifying the liquid ejection head of this embodiment.

This embodiment is obtained by modifying the configuration of the communication hole 202 that is to be used as etching hole for forming the space 102 of the first embodiment and also the configuration of the communication hole 202 of the second embodiment. More specifically, the communication hole 202 is formed not in the substrate 101 but in the first thin film 103. Accordingly, the configuration of the seal (closure) of the communication hole 202 differs from that of the first embodiment and that of the second embodiment. More specifically, as shown in FIG. 7A, the communication hole 202 is sealed by second protection film 111. Note that, if the communication hole 202 cannot satisfactorily be sealed by the second protection film 111 because of the aspect ratio of the communication hole 202, the height of the sacrificial layer 201 and the film thickness of the second protection film 111, the first protection film 110 can also be employed for sealing the communication hole 202 as shown in FIG. 7B. Furthermore, as shown in FIG. 7C, layer 101*c* that is made of the material same as the material of the lead-out wire 101*b* from the upper electrode 105 and the lower electrode 106 can also be employed for sealing the communication hole 202.

Figure 7B:
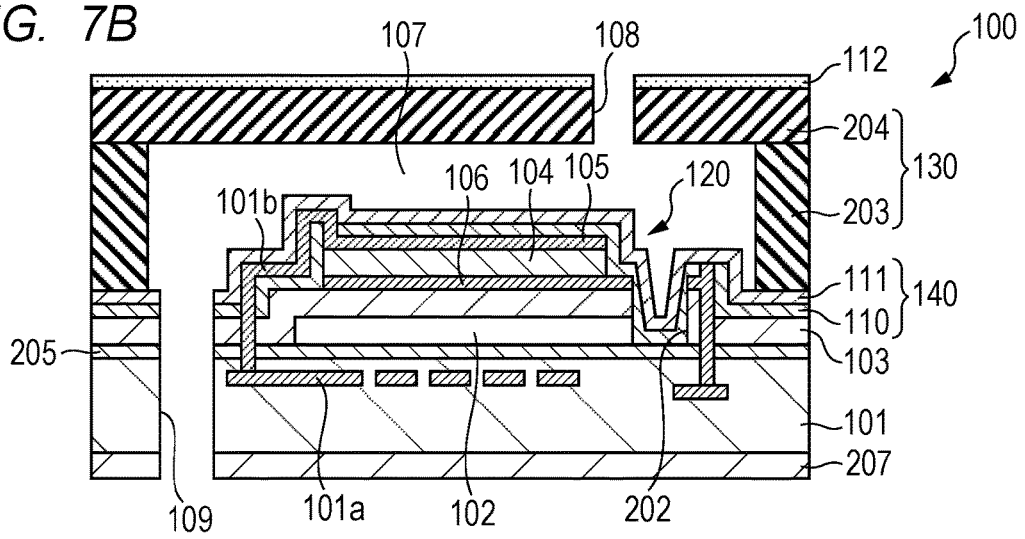
Figure 7C:
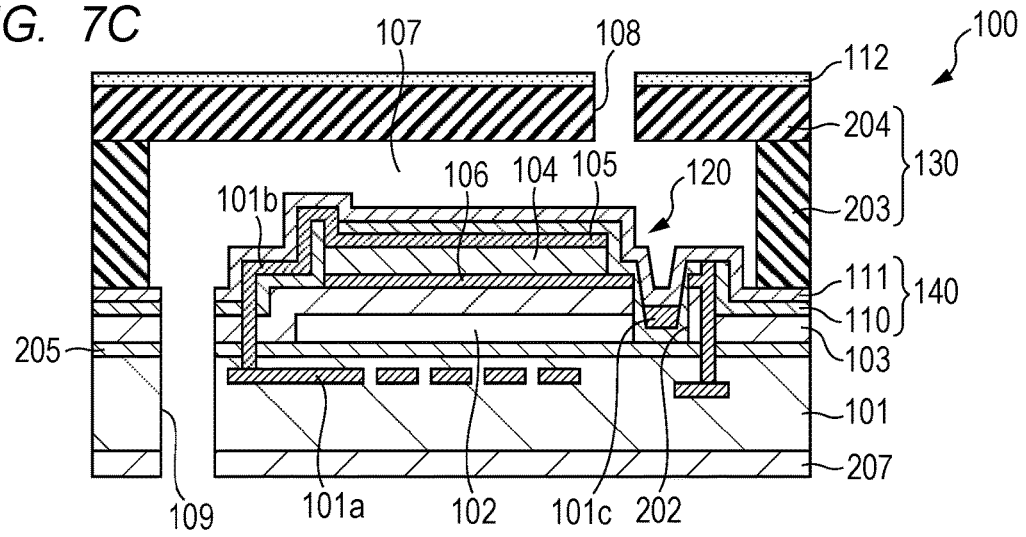
Figure 8A:
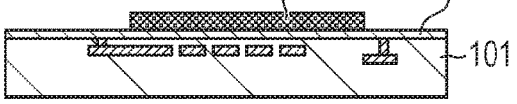
FIGS. 8A, 8B, 8C, 8D, 8E, 8F, 8G, 8H, 8I, 8J, 8K and 8L are schematic cross-sectional views of the third embodiment of liquid ejection head according to the present invention, illustrating different steps of the method of manufacturing the liquid ejection head.
Figure 8B:
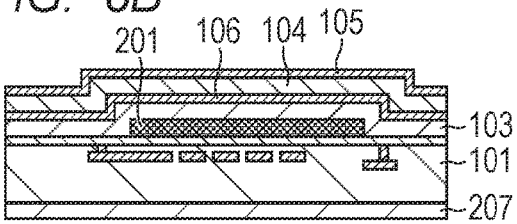
Figure 8C:
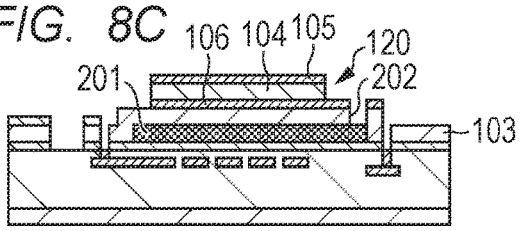
Figure 8D:
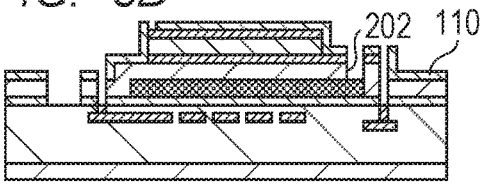
Figure 8E:
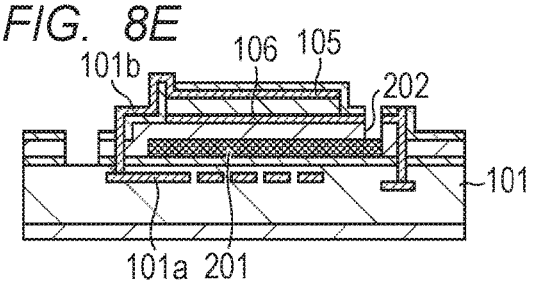
Figure 8F:
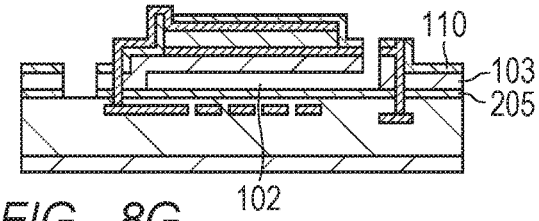
Figure 8G:
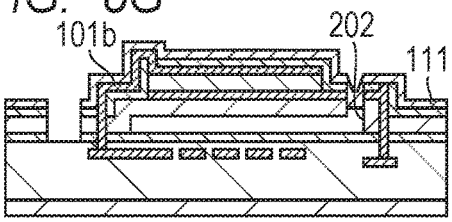
Figure 8H:
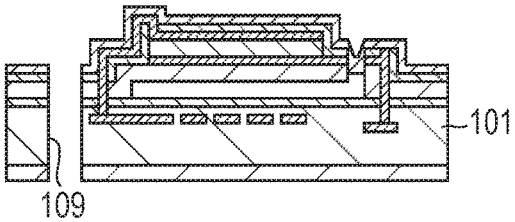
Figure 8I:
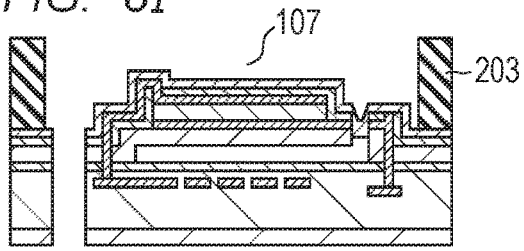
Figure 8J:
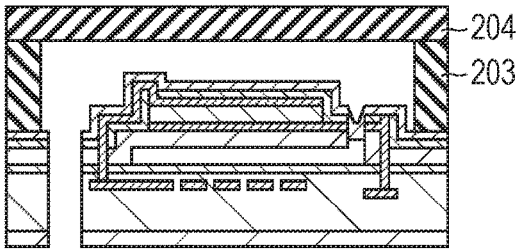
Figure 8K:
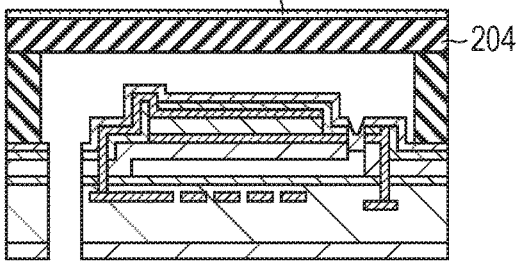
Figure 8L:
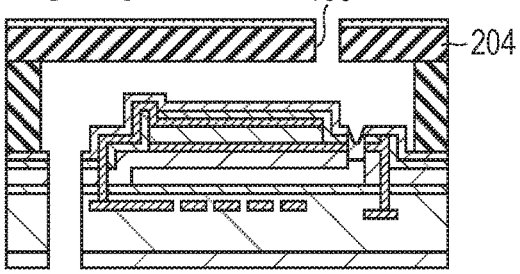

Note that FIGS. 7A through 7C show liquid ejection heads obtained by modifying the communication hole 202 of the second embodiment, of which the ejection port forming member 130 is formed by using two members 203 and 204, and the communication hole 202 of the first embodiment can also be modified in a similar manner.

Now, the method of manufacturing the liquid ejection head of this embodiment will be described below by referring to FIGS. 8A through 8L. FIGS. 8A through 8L are schematic cross-sectional views of the liquid ejection head of this embodiment in different manufacturing steps. Note that the steps (8*a*) through (8*l*) that will be described below respectively correspond to FIGS. 8A through 8L. With the manufacturing method that will be described below, the etching hole (communication hole) 202 is sealed only by means of the second protection film 111 (see FIG. 7A).

(8*a*) A substrate 101 similar to the substrate 101 brought in for the step (3*a*) of the first embodiment is also brought in here and substrate protection film 205 is formed thereon. Subsequently, sacrificial layer 201 is formed by following the operation sequence same as that of Step (3*b*) of the first embodiment under the conditions same as those of Step (3*b*) of the first embodiment. A material that shows high etching selectivity relative to the sacrificial layer 201 is employed for the substrate protection film 205. When, for example, the sacrificial layer 201 is made of Al, Si can be employed for the substrate protection film 205 as in the instance of the above-described first combination, although $SiO_2$ or SiN can alternatively be employed for the substrate protection film 205. Still alternatively, no substrate protection film 205 may be formed at all. When no substrate protection film 205 is formed, a material that is not dissolved by Al wet etchant (Au or the like) needs to be employed for the lead-out wire from the upper electrode 105 and from the lower electrode 106 or the surface of the lead-out wire needs to be protected before removing the sacrificial layer 201. When, on the other hand, the sacrificial layer 201 is made of $SiO_2$ as in the instance of the above-described second combination, Si or SiN can be employed for the substrate protection film 205. Alternatively, no substrate protection film 205 may be formed at all. When the sacrificial layer 205 is made of Si as in the instance of the above-described third combination, the use of $SiO_2$ or SiN is suitable for the substrate protection film 205.

(8*b*) First thin film 103 that operates as vibration plate, lower electrode 106, piezoelectric body 104 and upper electrode 105 are formed on the substrate 101 and the sacrificial layer 201 in the above-mentioned order by following the operation sequence same as that of Step (3*c*) of the first embodiment under the conditions same as those of Step (3*c*) of the first embodiment. In addition to the first thin film 103, substrate protection film 207 is formed on the surface of the substrate 101 that is located opposite to the surface thereof where the first thin film 103 is formed by using the material same as the material of the first thin film 103.

(8*c*) A patterning operation is conducted on the upper electrode 105, the piezoelectric body 104 and the lower electrode 106 by means of photolithography by following the operation sequence same as that of Step (3*d*) of the first embodiment under the conditions same as those of Step (3*d*) of the first embodiment to produce piezoelectric element 120.

Subsequently, the first thin film 103 is subjected to a patterning operation by means of photolithography to produce a through hole and an etching hole (communication hole) 202 for the lead-out wire of the upper electrode 105 and the lower electrode 106. Dry etching can be used for the patterning operation. The etching hole 202 is formed through the first thin film 103 so as to be held in communication with an end of the sacrificial layer 201 with an aperture area smaller than the area of the top surface of the sacrificial layer 201 (the region corresponding to the first thin film 103). The appropriate aperture diameter of the etching hole 202 is between about 1 μm and about 10 μm. When the aperture diameter is small, a plurality of etching holes 202 may preferably be formed in order to raise the etching rate for removing the sacrificial layer 201. Note that the etching hole 202 needs to be formed at a position that allows the pattern of the lower electrode 106 to detour around the etching hole 202 and become connected to the connecting section with the lead-out wire.

(8*d*) First protection film 110 is formed and patterned to expose the through hole for the lead-out wire and the through hole to be brought into communication with the etching hole 202 by following the operation sequence same as that of Step (3*f*) of the first embodiment under the conditions same as those of Step (3*f*) of the first embodiment.

(8*e*) Lead-out wire 101*b* for connecting the upper electrode 105 and the lower electrode 106 to the wiring layer 101*a* on the substrate 101 is formed by following the operation sequence same as that of Step (3*g*) of the first embodiment under the conditions same as those of Step (3*g*) of the first embodiment. At this time, the through hole to be brought into communication with the etching hole 202 becomes exposed by a patterning operation.

(8*f*) The sacrificial layer 201 is removed by etching to produce space 102. As described above, the specific etching technique to be employed here needs to be appropriately selected according to the material of the sacrificial layer 201. As an example, if the substrate protection film 205 is made of $SiO_2$ and the first thin film 103 that operates as vibration plate is made of SiN while the first protection film 110 is made of $SiO_2$ and the sacrificial layer 201 is made of Si, a dry etching technique involving the use of $XeF_2$ can be employed.

(8*g*) Second protection film 111 is formed to protect the lead-out wiring 101*b* and seal the etching hole 202 by following the operation sequence same as that of Step (3*h*) of the first embodiment under the conditions same as those of Step (3*h*) of the first embodiment. At this time, a patterning operation is conducted to expose the through hole that is to be brought into communication with supply port 109 that is to be formed in a post process. If oxide film formed by ALD is employed for the second protection film 111, it is difficult to make the second protection film 111 show a thickness sufficient for sealing the etching hole 202. Therefore, some other layer may be used in combination with the second protection film as sealing layer for sealing the etching hole 202. More specifically, the first protection film 110 may be used in combination as shown in FIG. 7B or a layer made of the material of the first protection film 110 and that of the lead-out wire 101*b* may be used in combination as shown in FIG. 7C. Such a sealing operation becomes executable as the sacrificial layer 201 is removed after Step (8*c*) and before Step (8*d*) and Step (8*e*). If such an operation is to be conducted, the material of the sacrificial layer 201 and the etchant to be used for the etching operation need to be such that they can secure sufficient etching selectivity relative to the piezoelectric body 104, the upper electrode 105 and the lower electrode 106.

(8*h*) Supply port 109 is formed in the substrate 101 by means of D-RIE from the surface of the substrate 101 opposite to the surface thereof where the piezoelectric element 120 is formed. The aperture diameter of the supply port 109 is preferably between about 60 μm and about 120 μm (80 μm×120 μm with the arrangement of ejection ports 108 shown in FIG. 2).

(8*i*) First member 203 having pressure chamber 107 is formed by following the operation sequence same as that of Step (6*a*) of the second embodiment under the conditions same as those of Step (6*a*) of the second embodiment.

(8*j*) Second member 204 that is made of Si is bonded to the first member 203 and polished to make it show a desired thickness by following the operation sequence same as that of Step (6*b*) of the second embodiment under the conditions same as those of Step (6*b*) of the second embodiment.

(8*k*) Water repellent film 112 is formed on the second member 204 by following the operation sequence same as that of Step (6*f*) of the second embodiment under the conditions same as those of Step (6*f*) of the second embodiment.

(8*l*) Ejection port 108 is formed in the second member 204 by following the operation sequence same as that of Step (6*g*) of the second embodiment under the conditions same as those of Step (6*g*) of the second embodiment. The operation of forming liquid ejection head 100 of this embodiment as shown in FIG. 7A is completed in this way.

This embodiment provides the advantages as will be described below in addition to the advantages provided by the first and second embodiments. Namely, as a result of forming the etching hole 202 in the first thin film 103, the region of the substrate 101 that faces the sacrificial layer 201 can entirely and effectively be utilized as space for arranging wires and integrated circuits to make it possible to more densely arrange ejection ports 108. Additionally, the fall in the rigidity of the substrate 101 caused by arranging the etching hole 202, which is a through hole, in the substrate 101 can be suppressed. Furthermore, with the preceding embodiments, the etching hole 202 formed in the substrate 101 is narrow and deep and hence it is difficult for the etchant for removing the sacrificial layer 201 to deeply get into the etching hole 202 to make the etching operation a time consuming one. However, this embodiment provides an advantage that the etching time can be reduced.

As described above, the present invention provides a liquid ejection head that allows ejection ports to be densely arranged and additionally allows the vibration plates to be sufficiently displaced and also a method of manufacturing such a liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-236635, filed Dec. 6, 2016 which is hereby incorporated by reference herein in its entirety.

What is claimed is:

1. A liquid ejection head comprising:

a substrate;

a piezoelectric element provided on the substrate;

an ejection port forming member having an ejection port for ejecting liquid, the ejection port forming member being provided on the substrate carrying the piezoelectric element such that a pressure chamber is formed between the ejection port forming member and the substrate to contain the piezoelectric element therein and be held in communication with the ejection port;

a first thin film arranged between the substrate and the piezoelectric element such that a space is formed between the substrate and the first thin film; and a second thin film arranged on the piezoelectric element such that the piezoelectric element is sandwiched between the first thin film and the second thin film, wherein the piezoelectric element has a lateral surface, and the first thin film is not in contact with the lateral surface, the second thin film is in contact with the lateral surface of the piezoelectric element, and wherein the first thin film has a first rigidity and the second thin film has a second rigidity, the first rigidity being higher than the second rigidity.

2. The liquid ejection head according to claim 1, wherein the first thin film is made of a material having a first Young's modulus and the second thin film is made of a material having a second Young's modulus, the first Young's modulus being higher than the second Young's modulus.

3. The liquid ejection head according to claim 1, wherein the first thin film has a first film thickness and the second thin film has a second film thickness, the first film thickness being greater than the second film thickness.

4. The liquid ejection head according to claim 1, wherein at least either the first thin film or the second thin film is a multilayer film.

5. The liquid ejection head according to claim 1, wherein the ejection port forming member includes a first member made of a resin material forming the pressure chamber and a second member made of an inorganic material forming the ejection port.

6. The liquid ejection head according to claim 1, wherein the ejection port forming member is made of an inorganic material.

7. A liquid ejection head comprising:

a substrate;

a piezoelectric element; and an ejection port forming member having an ejection port arranged in this order, wherein the liquid ejection head has a pressure chamber formed as a space between the substrate and the ejection port forming member, wherein a first thin film and a second thin film are arranged such that the first thin film covers a first surface of the piezoelectric element, which faces the substrate, and the second thin film covers a second surface of the piezoelectric element, which faces the pressure chamber, and wherein the second thin film also covers a lateral surface of the piezoelectric element.

8. The liquid ejection head according to claim 7, wherein a rigidity of the first thin film is greater than a rigidity of the second thin film.

9. The liquid ejection head according to claim 8, wherein the rigidity of the first thin film and the rigidity of the second thin film are represented by values of Young's modulus.

10. The liquid ejection head according to claim 7, wherein a film thickness of the first thin film is greater than a film thickness of the second thin film.

11. The liquid ejection head according to claim 7, wherein the liquid ejection head has a space between the substrate and the first thin film.

12. The liquid ejection head according to claim 7, wherein at least either the first thin film or the second thin film is a multilayer film.

13. The liquid ejection head according to claim 7, wherein the ejection port forming member includes a first member made of a resin material forming the pressure chamber and a second member made of an inorganic material forming the ejection port.

14. The liquid ejection head according to claim 7, wherein the ejection port forming member is made of an inorganic material.

* * * * *